US009162794B2

(12) United States Patent
Robbins, III et al.

(10) Patent No.: US 9,162,794 B2
(45) Date of Patent: Oct. 20, 2015

(54) BEVERAGE DELIVERY CAN

(71) Applicant: Boston Beer Corporation, Boston, MA (US)

(72) Inventors: Zebulon Stevens Robbins, III, Duxbury, MA (US); Charles James Koch, Newton, MA (US); Peter D. Gladstone, Arlington, MA (US); Andrew S. Gavrin, Villanova, PA (US); Jeewon Jung, Boston, MA (US); Oivind Brockmeier, Medford, MA (US)

(73) Assignee: Boston Beer Corporation, Boston, MA (US)

( * ) Notice: Subject to any disclaimer, the term of this patent is extended or adjusted under 35 U.S.C. 154(b) by 0 days.

(21) Appl. No.: 13/902,437

(22) Filed: May 24, 2013

(65) Prior Publication Data

US 2014/0008367 A1 Jan. 9, 2014

Related U.S. Application Data

(60) Provisional application No. 61/651,624, filed on May 25, 2012.

(51) Int. Cl.
*B65D 17/32* (2006.01)
*B65D 8/00* (2006.01)
(Continued)

(52) U.S. Cl.
CPC .. *B65D 7/04* (2013.01); *B65D 7/42* (2013.01); *B65D 7/44* (2013.01); *B65D 17/02* (2013.01);
(Continued)

(58) Field of Classification Search
CPC ..... B65D 17/163; B65D 17/165; B65D 2517/001–2517/002; B65D 2517/0026–2517/0029; B65D 7/04; B65D 17/02; B65D 17/18; B65D 7/44; B65D 7/42
USPC ..... 426/115, 118, 122, 123, 131, 592, 16; 220/270, 213, 236.1, 258.2, 269, 276, 220/375, 377, 602, 669, 713, 712, 906; D7/509, 527, 531
See application file for complete search history.

(56) References Cited

U.S. PATENT DOCUMENTS 2,614,406 A * 10/1952 Carpenter ..... 220/718
2,782,614 A * 2/1957 Currie ..... 220/718
(Continued)

FOREIGN PATENT DOCUMENTS

GB 2364292 A * 1/2002
JP 08252159 A 10/1996
(Continued)

OTHER PUBLICATIONS www.realbeer.com/edu/betterglass.php , Building a better beer glass, 2007.*
(Continued)

*Primary Examiner* — Drew Becker
(74) *Attorney, Agent, or Firm* — GTC Law Group LLP & Affiliates

(57) ABSTRACT

A beverage delivery can may comprise various configurations. Such configurations may comprise various aperture shapes, sizes, and configurations and various shapes, textures, configurations, and dimensions of the lid and surface of the can. A beverage can may comprise various exterior shapes such as a tapered shape, a faceted shape, a pint glass shape and the like. In embodiments, the beverage can may comprise various types of nucleation devices. In embodiments, various external packaging may be used with one or more beverage delivery cans.

13 Claims, 16 Drawing Sheets

(51) Int. Cl.

| | |
|---|---|
| ***B65D 6/00*** | (2006.01) |
| ***B65D 17/00*** | (2006.01) |
| ***B65D 6/34*** | (2006.01) |

(52) U.S. Cl.

CPC ..... *B65D 17/165* (2013.01); *B65D 17/18* (2013.01); *B65D 2517/0013* (2013.01); *B65D 2517/0017* (2013.01); *B65D 2517/0026* (2013.01)

(56) References Cited

U.S. PATENT DOCUMENTS

| | | | | |
|---|---|---|---|---|
| 2,977,029 | A * | 3/1961 | Henchert | 222/548 |
| 3,029,973 | A * | 4/1962 | Burchett | 220/258.3 |
| 3,081,926 | A * | 3/1963 | Newton | 229/5.6 |
| 3,185,341 | A * | 5/1965 | Barbour | 220/718 |
| 3,420,367 | A * | 1/1969 | Carmichael | 206/432 |
| 3,462,042 | A * | 8/1969 | Stolle | 220/269 |
| 3,606,075 | A * | 9/1971 | Dunn | 220/273 |
| 3,692,202 | A * | 9/1972 | Parlagreco | 220/276 |
| 3,704,805 | A * | 12/1972 | Sheafe, III | 220/273 |
| 3,740,239 | A * | 6/1973 | Chancelloor, Jr. | 426/87 |
| 4,046,283 | A * | 9/1977 | Lockwood | 220/270 |
| 4,169,903 | A * | 10/1979 | Scholes | 427/460 |
| 4,291,640 | A | 9/1981 | Payne et al. | |
| 4,749,100 | A | 6/1988 | Eberhart | |
| 4,762,229 | A * | 8/1988 | Wickre | 206/459.5 |
| 4,784,283 | A * | 11/1988 | Cantu | 220/269 |
| 4,801,038 | A | 1/1989 | Grigorenko | |
| 4,925,050 | A * | 5/1990 | Yu | 220/716 |
| 5,040,698 | A * | 8/1991 | Ramsey et al. | 220/671 |
| 5,778,723 | A | 7/1998 | Diekhoff | |
| 5,788,111 | A * | 8/1998 | Waugh | 220/62.12 |
| 5,868,272 | A * | 2/1999 | Deal | 220/669 |
| 6,112,932 | A * | 9/2000 | Holdren | 220/269 |
| 6,290,084 | B1 * | 9/2001 | Louie | 220/254.4 |
| D477,751 | S * | 7/2003 | Chuang | D7/531 |
| 6,648,169 | B1 * | 11/2003 | Berger | 220/716 |
| 6,737,471 | B2 * | 5/2004 | Lorenz et al. | 524/773 |
| 6,824,003 | B1 * | 11/2004 | Wong | 220/254.9 |
| 7,748,557 | B2 * | 7/2010 | Robinson | 220/269 |
| 7,823,740 | B2 * | 11/2010 | Perra | 220/254.4 |
| 8,087,547 | B1 * | 1/2012 | Lindsey | 222/184 |
| D668,154 | S * | 10/2012 | Milne et al. | D9/516 |
| 2002/0000678 | A1 * | 1/2002 | Takai et al. | 261/122.1 |
| 2003/0127415 | A1 | 7/2003 | Carballido | |
| 2004/0195240 | A1 * | 10/2004 | Brandon | 220/269 |
| 2006/0096987 | A1 * | 5/2006 | Wry | 220/375 |
| 2006/0153956 | A1 * | 7/2006 | Ullmann | 426/397 |
| 2007/0187410 | A1 * | 8/2007 | Legorreta et al. | 220/375 |
| 2009/0095759 | A1 | 4/2009 | Kelly et al. | |
| 2011/0056945 | A1 * | 3/2011 | Ramsey et al. | 220/269 |
| 2011/0100854 | A1 * | 5/2011 | Chapin | 206/459.5 |
| 2012/0043324 | A1 * | 2/2012 | Baker et al. | 220/270 |
| 2013/0015187 | A1 * | 1/2013 | Tate et al. | 220/351 |
| 2013/0273224 | A1 * | 10/2013 | Manska et al. | 426/493 |
| 2014/0103040 | A1 | 4/2014 | Robbins et al. | |
| 2014/0190971 | A1 | 7/2014 | Robbins, III et al. | |

FOREIGN PATENT DOCUMENTS

| | | | |
|---|---|---|---|
| JP | 09103835 | A * | 4/1997 |
| JP | 2004001871 | A | 1/2004 |
| JP | 2004075087 | A | 3/2004 |
| JP | 1254559 | S | 10/2005 |
| WO | WO 92/17376 | * | 10/1992 |
| WO | 0162608 | A1 | 8/2001 |
| WO | 2005117616 | A2 | 12/2005 |
| WO | 2013177550 | A1 | 11/2013 |
| WO | 2014059312 | A1 | 4/2014 |
| WO | 2014150834 | | 9/2014 |

OTHER PUBLICATIONS

Translation of JP 09103835A.*

PCT/US/2013/042720, International Application Serial No. PCT/US/2013/042720, International Search Report and Written Opinion mailed Sep. 2, 2013, Boston Beer Corporation, 11 pages.

PCT/US2013/064603, "International Application Serial No. PCT/US2013/064603, International Search Report and Written Opinion mailed Jan. 17, 2014", Boston Beer Corporation, 15 Pages.

PCT/US2014/024360, "International Application Serial No. PCT/US2014/024360, International Search Report and Written Opinion mailed Jul. 11, 2014", Boston Beer Corporation et al., 15 pages.

* cited by examiner

SECTION A-A

BEVERAGE DELIVERY CAN

CROSS-REFERENCE TO RELATED APPLICATIONS

This application claims the benefit of the following United States Provisional Application, which is hereby incorporated by reference herein in its entirety: U.S. Provisional Application No. 61/651,624, entitled BEVERAGE DELIVERY CAN, filed May 25, 2012.

BACKGROUND

1. Field

The invention is related to the field of beverage delivery, and methods and systems for the creation of a beverage delivery can.

2. Description of the Related Art

Beverage cans have traditionally been considered to be less desirable drinking vessels than other vessels, such as the glass bottle, for reasons relating in part to aesthetic and tactile qualities, limitations on liquid flow from a can, ergonomic requirements of drinking from a can, and perceptual biases among beverage consumers. Beverage cans, such as beer cans, may have less weight than bottles or glasses and therefore feel less substantial to a consumer. The aperture of a standard can may restrict liquid flow from the can and require placing the mouth on what is perceived as a sharp edge. The aperture size and location on the can may limit the aroma of the beverage from reaching the sinus of the beverage drinker. The flat lid, or top, of beverage cans may limit the angle at which the can may be lifted relative to the user's mouth due to the fact that the user's nose is pressed to the lid as the angle increases. This may be uncomfortable for the user and also force the user to bend their neck to an uncomfortable angle in order to empty the beverage can of its contents. Beverage cans may also be perceived, especially among consumers of adult beverages, such as beer, as a distribution method of lower quality beverages. Therefore there is a need for methods and systems of creating beverage delivery cans that embody improved aesthetic and tactile qualities and have improved aperture and shape to permit greater sensory enjoyment of a can's contents while consuming the contents in an ergonomically comfortable posture.

SUMMARY

Provided in this disclosure are a variety of methods, structures and systems for improving beverage cans, the manufacture of beverage cans, and the experience of drinking beverage cans. These include methods and systems for improving the aesthetic qualities of the beer can, for improving the sensory experience of drinking a beverage, and the like.

In embodiments, a beverage can may comprise an external shape, wherein the shape is a pint glass shape; a lid that includes an aperture shaped and sized such that a user's nose will enter the beverage can during beverage consumption; and a nucleation device.

In embodiments, the external shape be a faceted shape.

In embodiments, the lid may be concave.

In embodiments, the lid may be enabled to change from opaque to transparent.

In embodiments, the nucleation device may be a ceramic nucleation device.

In embodiments, the nucleation device may be a nucleation ring.

In embodiments, the nucleation device may be a micro-etched plastic disc.

In embodiments, the nucleation device may be affixed to the bottom interior of the beverage can.

In embodiments, the aperture may be at least one of a bell shape, a peanut shape, a geometric hap, a converging shape, a diverging shape, a shape with curvilinear contours, a shape that resembles visual elements, and a shape that resembles a design element.

In embodiments, the beverage can may comprise a powder-coated top cover affixed to the lid.

In embodiments, the beverage can may comprise a surface enhancement located at least on the outside of the lid, wherein the outside of the lid may include at least the upper portion of the beverage can where the user's mouth touches the beverage can. In embodiments, the surface enhancement may comprise at least one of a rough surface and a surface with a glass feel.

In embodiments, the aperture may comprise a tab, wherein the tab may be capable of being twisted to puncture the lid of the can. In embodiments, the tab may be a slide tab and further capable of being slid to tear the lid of the can, and wherein the tab is capable of attaching to at least one of the side and bottom of the can. In embodiments, the tab may be capable of causing material to be removed from the can to create an opening in the lid wherein at least one of the tab and material is capable of being attached to the can.

These and other systems, methods, objects, features, and advantages of the present invention will be apparent to those skilled in the art from the following detailed description of the preferred embodiment and the drawings. All documents mentioned herein are hereby incorporated in their entirety by reference.

DETAILED DESCRIPTION

The present invention provides for an improved beverage can. Drinking from currently available beverage cans is generally perceived as a casual and less refined experience relative to serving or drinking the same beverage from a glass vessel, such as a bottle. Cans typically have less heft, sharper features, such as around the aperture, or opening of the can, from which the beverage is consumed, and may also lead to uncomfortable drinking ergonomics, such as requiring the consumer to physically bend one's neck to a less conformable degree than with a bottle, due in part to aperture size and shape. Currently available beverage cans are recognized as a convenient way to package and store beverages, with a less expensive production cost. Cans are fundamentally designed to store conveniently and open easily. Because current beverage can production and design are typically optimized for low cost, innovation has often been constrained to fit within the existing manufacturing operations. As a result, the look, feel, and overall sensory experience of a beverage consumed from a can may lack in taste and aroma, or be perceived by the consumer to lack such qualities, relative to other drinking vessel options. As taste is only one aspect of beverage enjoyment, the sight, feel and sound of the beverage can may influence the beverage drinking experience. The beverage can packaging, for example, may establish initial expectations, such as design and visual elements, which are then transferred by the drinker to the perceived taste of the beer. Aroma, another important factor in the drinking experience, may also be impacted by the packaging, particularly the shape and size of the container and drinking aperture, which may influence the intensity of the aroma.

Figure 1:
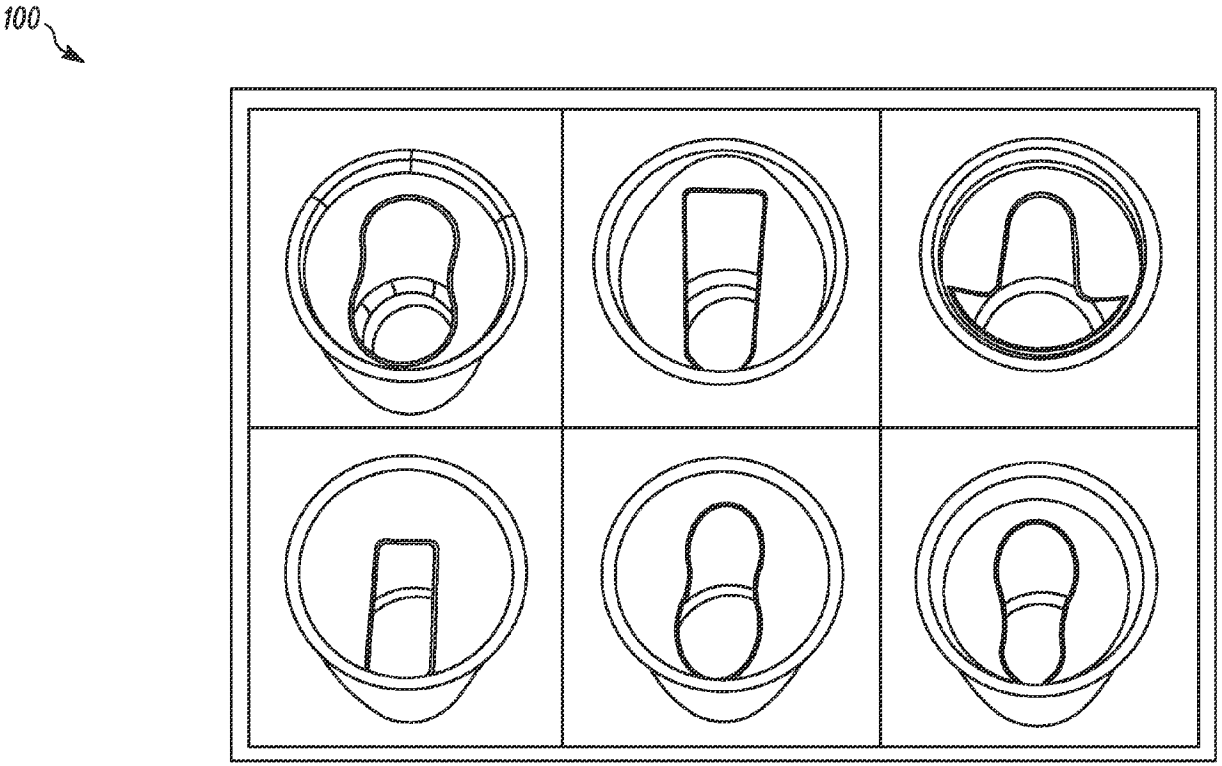
FIG. 1 illustrates beverage can aperture shapes enabling improved pour and aroma release qualities.
Figure 2B:
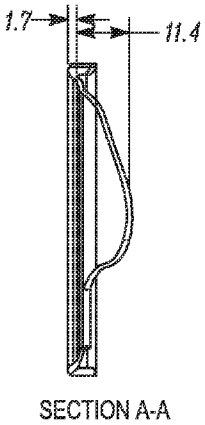
FIGS. 2 A-B illustrate an example dimension of a bell-shaped aperture.
Figure 2A:
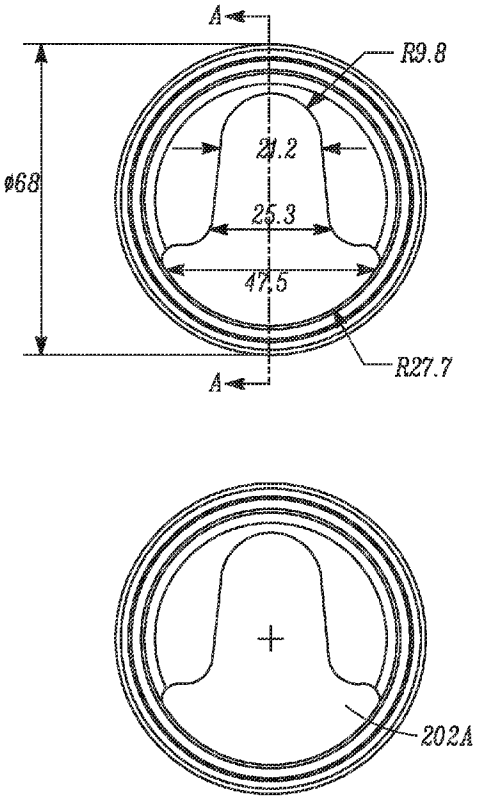
Figure 4B:
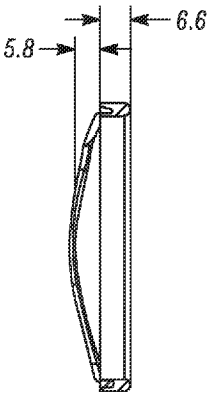
FIGS. 4 A-B illustrate an example dimension of a peanut-shaped aperture.
Figure 4A:
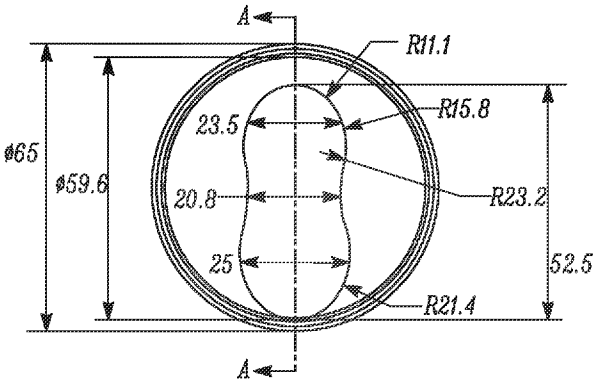
Figure 4A:
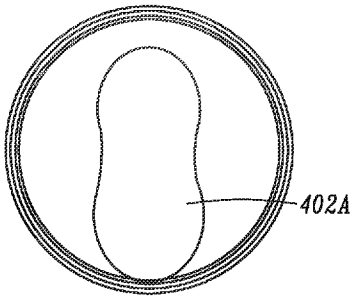

Referring to FIG. 1, in embodiments of the present invention, a plurality of beverage can aperture shapes, sizes and configurations are presented 100. In embodiments, the beverage can may have an aperture opening for drinking the beverage that, when opened, not only allows for the flow of liquid from the can, but for the exit of the beverage aroma from the can in sufficient amount and proximity to the nose of the consumer that the drinking experience is multi-sensory to a greater degree than in the currently available can apertures. In embodiments the aperture is constructed to allow the nose of the drinker to enter the can during beverage consumption, allowing the drinking to experience the aroma of the beverage in a way that is similar to consuming the beverage from an open-top container, such as a glass. In embodiments of the present invention, the aperture may take on a plurality of shapes including, but not limited to the shapes and configurations presented in FIG. 1. Shapes may include, but are not limited to, a bell shape 202A (as shown in FIGS. 2 A-B and 3 A-B), a peanut shape 402A (as shown in FIGS. 4 A-B and 5 A-B), a geometric shape, a converging/diverging shape, a shape with curvilinear contours, or shapes that resemble design/visual elements. A design/visual element may include, for example, a design element that resembles the logo or design element of a beverage manufacturer, to reinforce the association of the brand of the manufacturer with the beverage can.

Figure 3A:
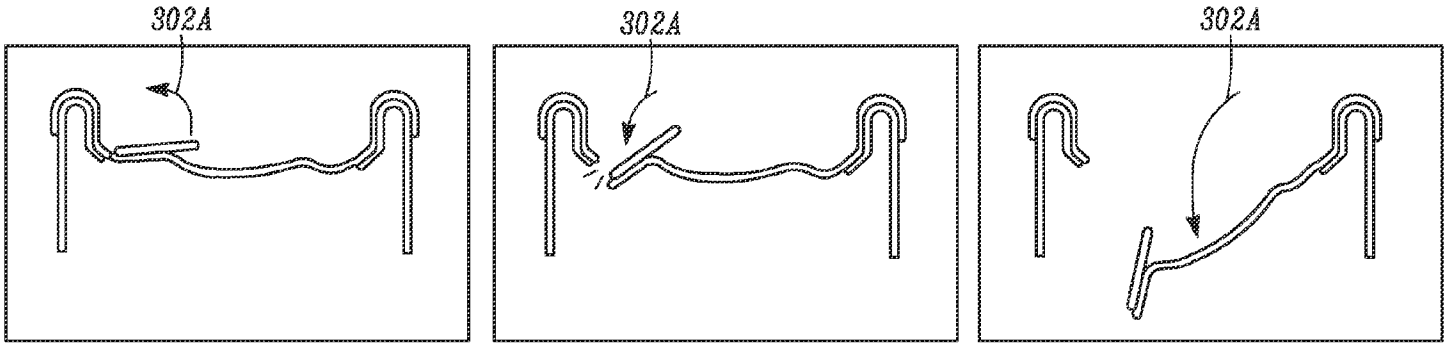
FIGS. 3 A-B illustrate an example bell-shaped aperture and corresponding tab apparatus.
Figure 3B:
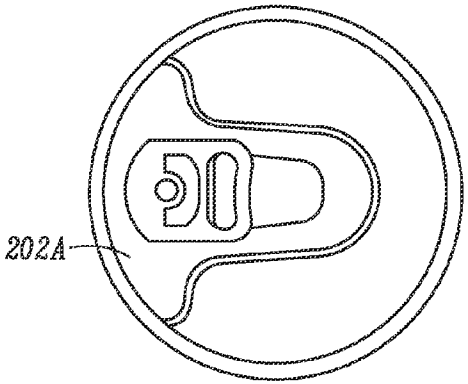
Figure 5A:
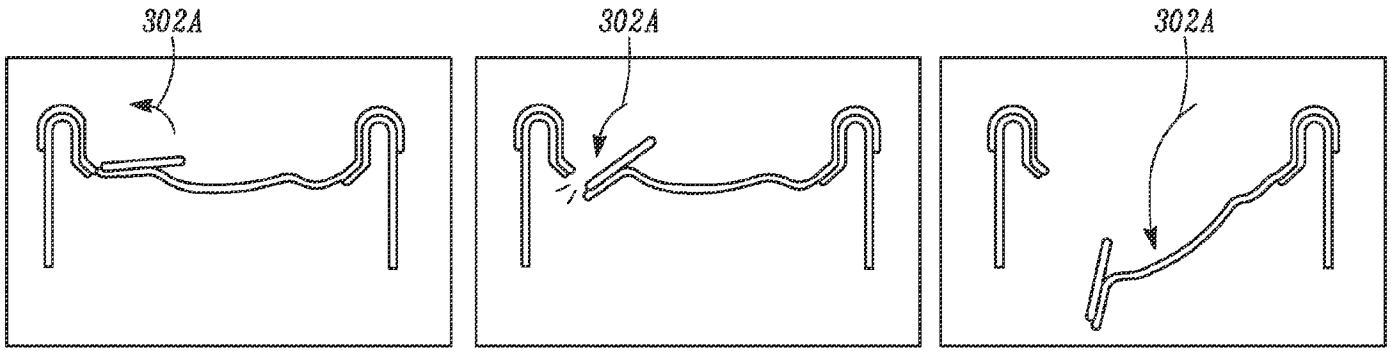
FIGS. 5 A-B illustrate an example peanut-shaped aperture and corresponding tab apparatus.
Figure 5B:
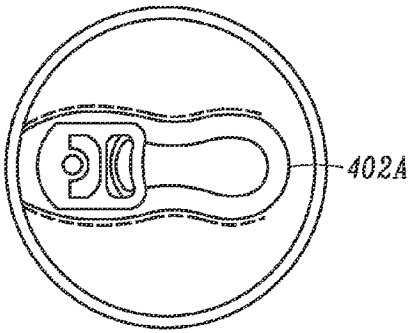

Each shape of aperture may have a pull back tab, a slide tab or a slightly longer tab. In embodiments, the tab, or material that is removed or displaced from a beverage can, may be enabled to be fully removed from the beverage can, such that it is no longer physically attached to the can, and placed in or on the beverage can or carrier from which the beverage can was removed. In an example embodiment, a tab or can top, after removal from the can, may be attached to the bottom of the beverage can using a snap, magnet, physical locking device, or some other means of securing the tab or top to the beverage can or the carrier from which the beverage can was removed. In another embodiment, the tab, or material that is removed or displaced from a beverage can may be secured to the carrier in which the beverage cans was packaged among a plurality of cans, such as within a "six-pack" or "four-pack." For example, the act of physically removing a beverage can from the carrier may cause the tab or top of the can to be removed from the can and remain secured to the carrier. In another example, the act of physically removing a beverage can from the carrier may not cause the tab or top of the beverage can to be removed, but instead the carrier may be functionally fitted with an area enabled to receive and secure a beverage can tab or top, such as using the methods of securing can tabs and tops, as described herein. In another embodiment, the tab or top of the beverage can may be partially removed from the beverage can, leaving behind material that may function as a hinge, permitting the user to bend the tab or top over to the side of the can where it may be secured, such as using a snap, magnet, physical locking device or some other means of securing the tab or top to the beverage can. As shown in FIGS. 3 and 5, a beverage can constructed according to the methods and systems of the present invention may include an aperture tab 302A that may be opened by twisting the tab in order to puncture the lid of the can. Continuing the example, further twisting of the tab may cause a score line in the lid of the can to become severed, allowing the user of the can to depress the tab apparatus into the can, such as by forcing the tongue into the depression created in the lid after the score line is severed by the twisting of the tab. In embodiments this type of tab apparatus may be applied to a plurality of aperture shapes and sizes, as described herein. In other example embodiments, the tab may be completely removable from the can, or may be a slide tab that attaches to the bottom or side of the can. A geometric shape used for the aperture shape may be, but is not limited to, a triangle, square, rectangle, hexagon, octagon, pyramid, organic shape, asymmetrical shape, or some other shape type. A converging/diverging shape may diverge toward the mouth and nose and converge in the middle. A bell shape may be a wide curve near the mouth, extending up more narrowly toward the nose. Example dimensions of a bell-shaped and peanut-shaped aperture are provided in FIGS. 2 and 4, respectively. Wider apertures may permit a user's nose to enter the vessel of the beverage can, as opposed to touching the exterior surface of the top of the can. By entering the can, the user's nose is in closer proximity to the liquid in the can and better able to smell the aroma of the liquid and better sense the flavor of the liquid. This may provide the user with a more comfortable drinking experience that is more analogous to the experience of drinking from a glass or other type of vessel that does not have a lid or top. Wider apertures may also permit the liquid within the can to be better viewed by the user. For example, a beverage such as beer may have a plurality of colors depending on the beer type. By providing a wider aperture, a user may have better visibility into the can and be able to better appreciate distinctive colors, carbonation, or other beverage qualities. Wider apertures along the circumference where the beverage is to be consumed may facilitate a smoother pour from the can. The smoother pour may improve beverage flow into the mouth, such as a continuous flow as opposed to the gurgling pour present with a too-small-aperture that requires intermittent interruptions to the flow in order to permit air intake to the can. The smoother pour may also facilitate a more gentle flow from the can, allowing the beverage, such as beer, to be poured into a drinking glass with less disruption to the liquid flow, permitting a more desirable mixture of liquid beer and carbonation (i.e., "head") in the glass once the entirety of the can is emptied into the drinking glass.

In embodiments, a beverage can lid or top may be transparent in order to permit viewing the contents of the can by a user or prospective buyer of the beverage. The transparent material used to make the can top may be engraved, etched or marked using some other means, including by using a second material to apply to the transparent material, for the purpose of placing an aesthetic feature on the material, such as a company logo, design, or other aesthetic element. In another embodiment, the transparent material may be engraved, etched or marked using some other means, including by using a second material to apply to the transparent material, for the purpose of placing words, information, or data on the material. For example, a transparent lid that permits viewing the beer contained in the beverage can may be etched with the words "See for yourself the amber color that won First Place in International Beer Contest X." In another embodiment, a beverage can lid may be made to be opaque during transport and storage but, upon opening, become clear, for example, by moving a facility that is comprised of a slat, or plurality of slats that, when moved in a direction, causes the can top to convert from an opaque to a transparent state. In another embodiment, a beverage can lid or top may consist of a fan facility comprised of slats that are arrayed in 360 degrees along the plane of the beverage can top, or arrayed in 360 degrees and conforming to a shape other than a flat plane, for example, a concave, conical, or other non-flat shape. Continuing the embodiment, the fan facility may be opened and closed by a user of the fan by twisting or turning the can top so that the individual slats in the fan facility fold into one another, providing an aperture opening in the can through which the beverage may be viewed, smelled, and consumed.

Figure 6B:
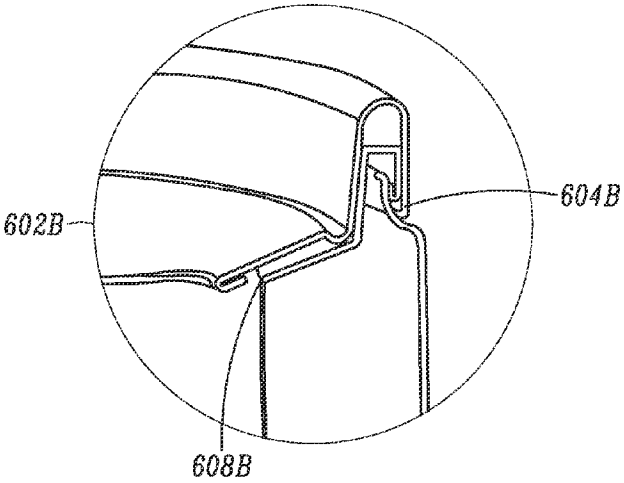
FIG. 6*b* illustrates a snap-on top cover with a recessed score line.
Figure 7B:
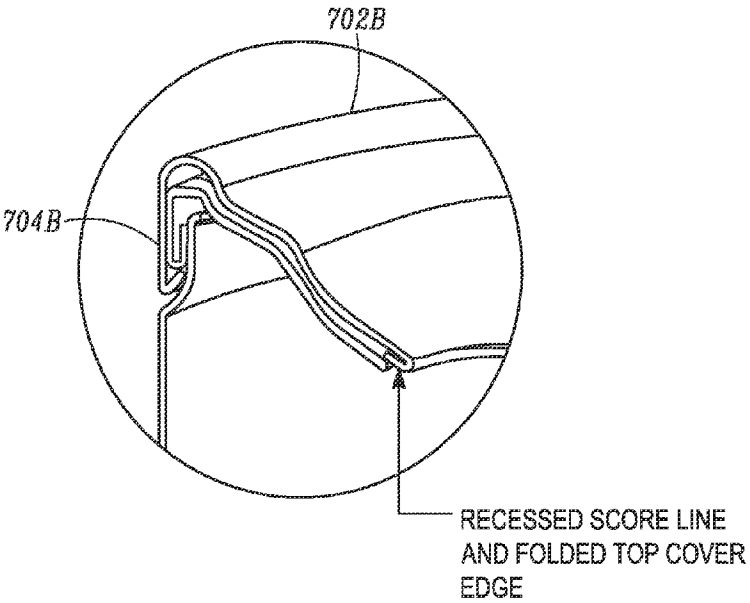
FIG. 7*b* illustrates a snap-on top cover with a folded top cover edge.
Figure 8B:
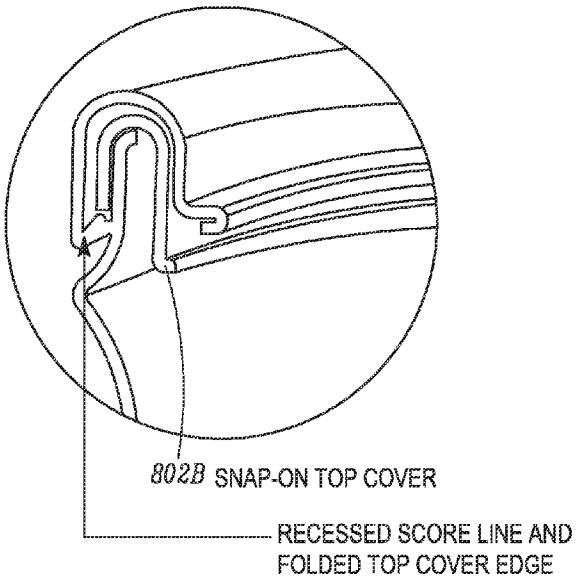
FIG. 8B illustrates a snap-on top cover with a folded cover edge and wide aperture.

Referring to FIGS. 6*b*, 7*b*, and 8*b*, in embodiments, a beverage can may have a "lip feel" that is created by the shape, texture and dimension of the beverage can lid. For example, as depicted in FIG. 6*b*, a beverage can lid 602B may have a snap-on top cover 604B with a deep recess. The recessed portion of the lid may have a score line and folded top cover edge 608B. The score line may be a weak point in the beverage can material that allows the can to be opened by a user action such as twisting, pushing, or manipulating the can lid in some other manner. Referring to FIG. 7*b*, a beverage can lid 702B may have a snap-on top cover 704B with a lid depression that is shallower than that depicted in FIG. 6*b*, with the gradated depression leading to an aperture of a different size that is depicted in FIG. 6*b*. FIG. 8*b* depicts another example of a snap-on top cover 802B. In this example, the removal of the snap-on top cover leaves an aperture that is nearly the entire diameter of the beverage can and in this way simulates the look and feel of a beverage glass insofar as there is virtually no lid material present that is horizontal to the can.

In embodiments, a beverage can may incorporate surface features that enhance the drinking experience. Such surface enhancements may impact the "lip feel" or "mouth feel" by altering the typical feeling of one's lips touching a metal can. The lip feel may be enhanced by a "Chipped Coffee Cup" application to simulate drinking from the edge of a glass. The lip feel may be included in the stamping/end cap manufacturer process or done during the post-processing phase of manufacturing. The surface of the beverage can may be given a rough texture by physically manipulating the surface, such as mechanically with a drill, file, sandpaper or some other device that is capable of roughening the beverage can surface. In embodiments, material may be added to the beverage can material to alter is smoothness or roughness, such as by covering the can with a resin, epoxy, polymer, plastic, glass, sand, silicone, fiber, or some other material (together "roughening/softening agents") capable of adhering to, or being applied within a beverage can material, such as aluminum, steel, or plastic. For example, such roughening/softening agents may be used to create a beverage can that simulates the feel of glass to the hand and/or mouth. In another example, a rough surface in an area of the beverage can to which the mouth makes contact may "awaken" the drinker by providing an element of surprise relative to the normal feel of touching one's lips to a can, and may also provide a different stimulus to the lips that is pleasurable and/or novel. In embodiments, the material used to roughen or smooth the beverage can may be applied to a surface coating that is applied to the beverage can, such as through a spray or dip process in which the can is coated in a substance capable of receiving and adhering to a roughening/softening agent, as described herein. In embodiments, a beverage can may have its surface texture altered by first dipping the can in a substance that adheres to the can and is capable of receiving and hold particles, and a second dipping process using the same can in which the can, having been coated in the substance, is dipped into a roughening/softening agent. Other deposition techniques may be used in conjunction with roughening/softening agents including, but not limited to, vapor, temperature manipulation, or some other deposition technique. In embodiments, a beverage can may have its surface texture altered by physically or chemically etching the surface of the can. Roughening/softening agents may be used to alter the surface of both the exterior and in the interior of the can. In embodiments, a beverage can's surface may be molded to provide texture and/or form. In embodiments, roughening/softening agents may be used to mimic the look and or feel of a material other than the material from which a beverage can is made. For example, resin, polymer or actual glass may be used for the upper portion of a can where a user's mouth touches the can to provide a "glass feel" to a can that is otherwise not made of glass.

In embodiments, a beverage can may include a nucleation device. A beverage can may have different exterior shapes. Exterior shapes may include, but are not limited to, a tapered shape, a faceted shape, a pint glass shape, or some other exterior shape. Each shape may have internal features, construction, opening method, and external packaging, including external packaging that is used to join a plurality of cans together for the purposes of transportation.

Figure 6A:
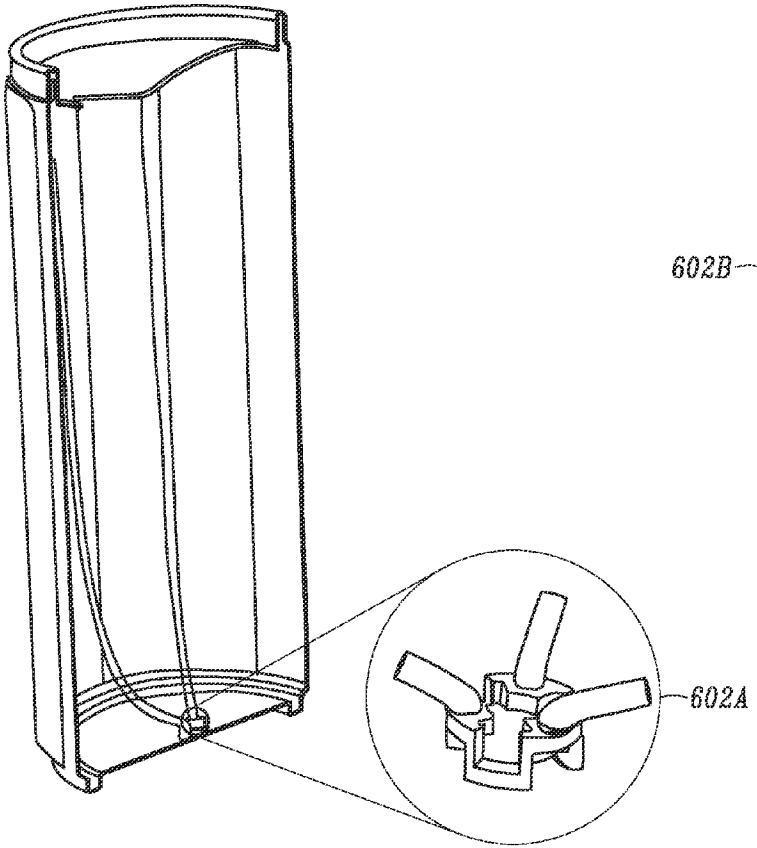
FIG. 6*a* illustrates a ceramic nucleation device in a plastic frame.
Figure 7A:
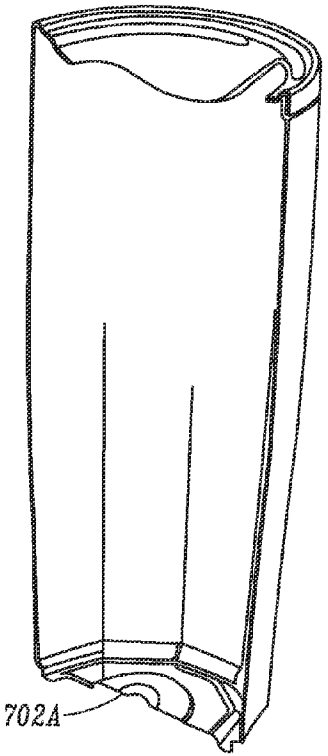
FIG. 7*a* illustrates nucleation device using a plastic disc with micro etching placed on the bottom surface of a beverage can.
Figure 8A:
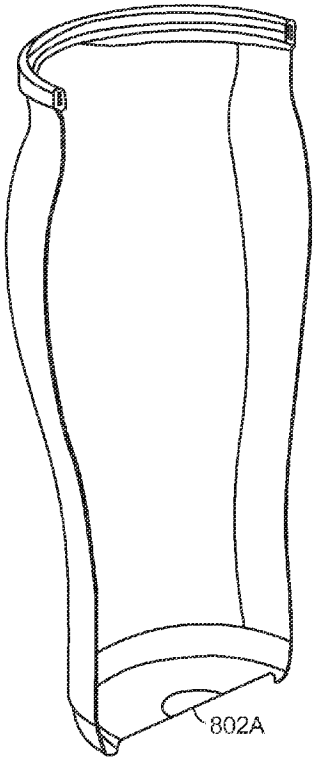
FIG. 8A illustrates nucleation ring placed on the bottom surface of a beverage can.

The term nucleation, as used herein, refers to the process that may occur when there is a change in pressure inside a vessel, such as that caused by opening a beverage can, that may cause dissolved carbon dioxide to begin escaping from the liquid contained within the beverage can. Nucleation sites may exist on an interior surface of a glass, a bottle, or a beverage can in the form of microscopic cracks, scratches, particles adhered to the surface (e.g., fiber particles from a dish cloth), or some other surface defect, deformation, or surface feature. Nucleation sites may also be intentionally created on the interior surface of the beverage can, such as according to the methods and systems of nucleation enhancement as described herein. As carbon dioxide releases from the liquid, it may gather at a nucleation site until it reaches a critical volume when it can release into the liquid, for example in the form of a gas bubble, and rise to the liquid surface. As nucleation occurs, it may form columns of gaseous bubbles rising in the liquid and in some beverages, such as beer, cause a foam or a "head" to form at the surface of the beer. This may have the effect of increasing the sensory enjoyment of the beer, as the nucleation may increase the flavor and aroma release from the beer. Further, the foam created by the nucleation may be visually appealing to the drinker, as a proper foam or "good head" is a quality that is recognized and preferred by many beer drinkers. Increased nucleation, such as that created using the methods and systems described herein, may also be more readily seen, smelled and appreciated when occurring within a beverage can with a larger aperture that permits viewing into can and/or placing one's nose in closer proximity to the liquid than is permitted by traditional cans with smaller apertures. FIGS. 6A, 7A, and 8A depict a plurality of example nucleation devices of a beverage can according to the present invention. In embodiments the nucleation device may be, but is not limited to, a ceramic nucleator 602A, such as housed within a plastic frame (FIG. 6*a*), a disk attachment facility, a ceramic facility, or a laser etching. The disc attachment nucleation facility may be, but is not limited to, a plastic disc 702A with micro etching on its surface, as shown in FIG. 7*a*, which may attach to the bottom of the beverage can. The ceramic facility may be, but is not limited to, a ceramic nucleator 602A at the bottom of the beverage can in a plastic frame that extends from the bottom to the top of the beverage can, as shown in FIG. 6*a*. The laser etching nucleation facility may be, but is not limited to, a nucleation ring 802A that is laser etched through the interior coating of a beverage can, as shown in FIG. 8*a*. Nucleation may improve the quality, texture and carbonation of the beverage housed in the can.

Figure 9B:
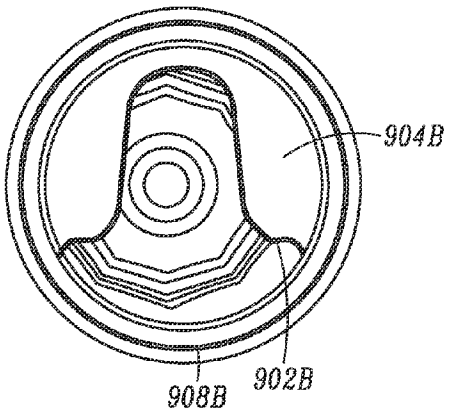
FIGS. 9 A-B illustrates a tapered shape beverage delivery can.
Figure 9A:
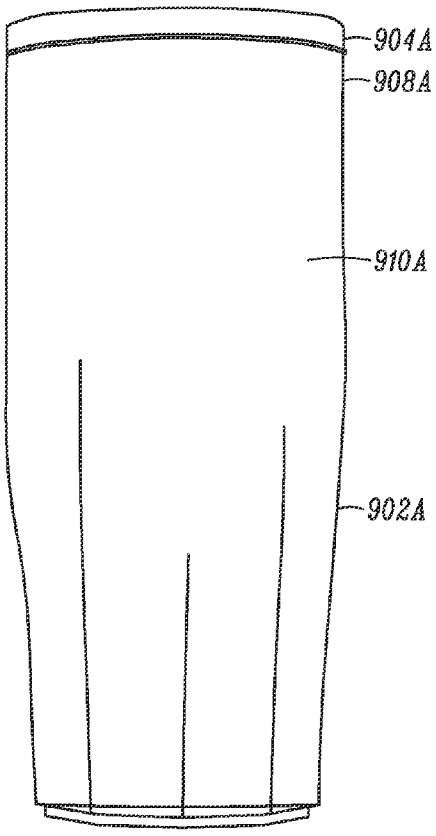
Figure 12:
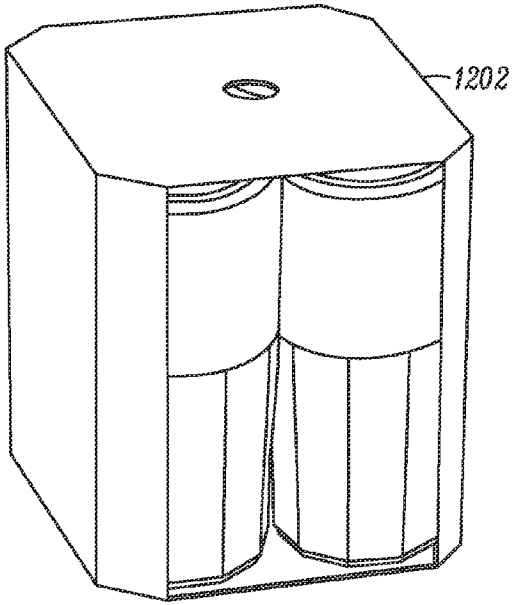
FIG. 12 illustrates an example embodiment of a four-pack carrier for beverage cans.
Figure 13:
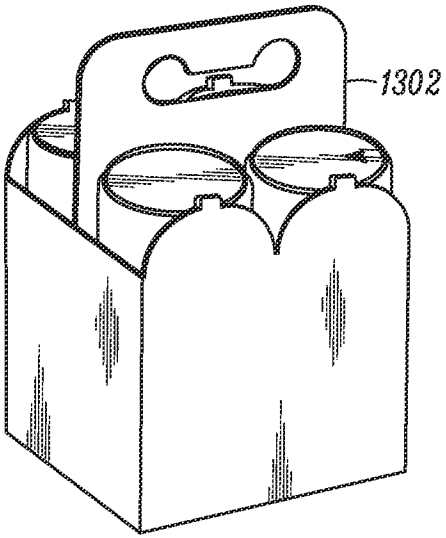
FIG. 13 illustrates an example embodiment of a four-pack carrier for beverage cans that includes dust cover lids for each can.

In embodiments, a beverage can may have a plurality of exterior shapes. Shapes may include, but are not limited to, a tapered shape 902A (FIG. 9A), a faceted shape 1002A (FIG. 10A), or a pint glass shape 1102A (FIG. 11A). Referring to FIGS. 9 A-B, the feature of the tapered shape may include, but are not limited to, a powdercoated top cover 904A, flush surfaces 908A between the top and the body, heavy gauge walls 910A, bell shaped aperture 902B, deep concave surface 904B, and a wide rim 908B. The concavity of the beverage can top may serve to increase the comfort with which the beverage may be consumed insofar as the concavity may permit the contents of the beverage can to be fully consumed from a more ergonomically comfortable position for the user. By having a concave depression in the top of the can, a user's upper-lip, nose and other facial features may be able to break the horizontal plane where a typical beverage can top would be located, making the drinking experience more comfortable and analogous to drinking from a glass, such as a beer pint glass. In combination with an aperture, an increased aperture size and/or anthropomorphic shape, as described herein, the concavity of the top may serve as a chamber in which the aroma of the beverage is momentarily trapped in close proximity to the user's nose. This may increase the enjoyment and appeal of the beverage. In embodiments, in addition to the concave top including an aperture through which a user may consume the beverage, the concave top may have another opening, or plurality of openings, that enable greater aroma from the beverage to release from the can. In embodiments, as nucleation occurs within a beverage, such as a beer, and rises to the top of the liquid as a foam, the concavity of the top may enable the foam to remain held within the depression of the top, as opposed to pouring over the edge as it would in a typical can with a flat top. The concavity may also enable for liquid to pour back into the can, such as when a user lowers the can from the mouth, instead of having the liquid flow along the surface of the can top or down the side of the can. The concavity may also, in addition to providing an area for the foam of the beverage to gather, may also enable the foam to settle back into the beverage can over time in a manner analogous to the rise and fall of foam within, for example, a beer glass. In embodiments, the shape of the concavity may be molded. In an example, the concavity may be molded to include the logo of a beverage company or some other type of aesthetic feature. The construction details of a tapered shape may include, but are limited to, a ceramic nucleator in a plastic frame, plastic disk nucleator, or laser ring nucleator, a snap-on top cover, and a recessed score line and folded top cover edge. An example opening method of a tapered shape beverage can may include, but is not limited, to twisting the tab to puncture the lid, continuing to twist the tab to start tearing the score line, and pushing the tongue into the can to fully open the aperture. FIGS. 12 and 13 depict sample embodiments of external packaging solutions that be used on the tapered shape beverage can, which may include, but is not limited to, a four pack carrier 1202 and 1302 that protects the top of the can and openings on the front and back that shows the unique shape of the can. Similar packaging solutions may be used for other external beverage can shapes, as described herein.

Figure 10B:
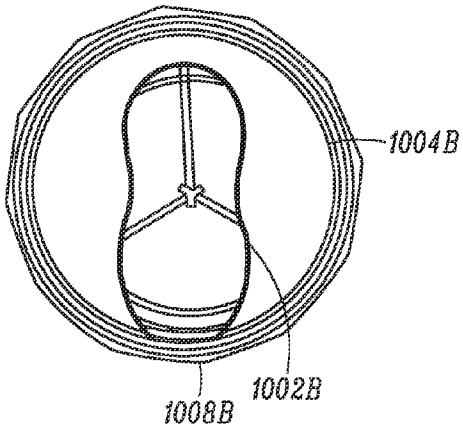
FIGS. 10 A-B illustrate a faceted shape beverage delivery can.
Figure 10A:
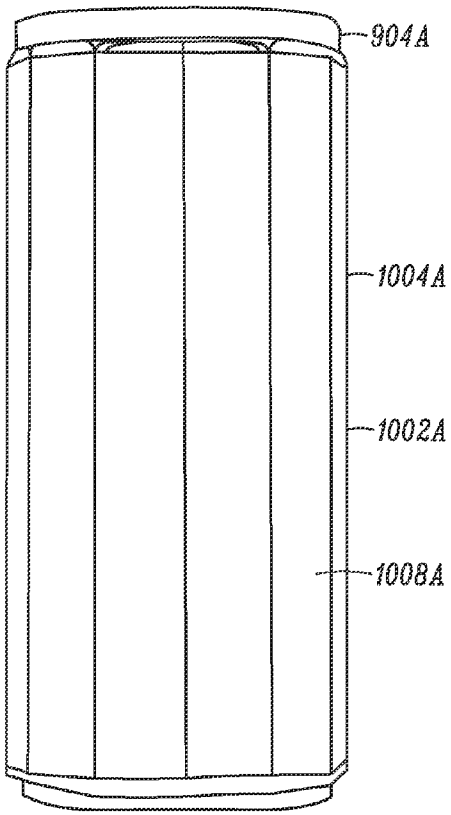

FIGS. 10 A-B depict a beverage can with a faceted shape. Example features of the faceted shape may include, but are not limited to, a powdercoated top cover 904A, structural facets 1004A to provide stiffness, insulating paper sleeve label 1008A, peanut shaped aperture 1002B on a slightly concave surface 1004B, and a wide rim 1008B. The construction details of a faceted shape beverage can may include, but are limited to, a ceramic nucleator in a plastic frame, plastic disk nucleator, or laser ring nucleator, snap-on top cover, recessed score line, and folded top cover edge. The opening method of the faceted shape may include but is not limited to twisting the tab to puncture the lid, continuing to twist the tab to start tearing the score line, and pushing the tongue into the can to fully open the aperture.

Figure 11B:
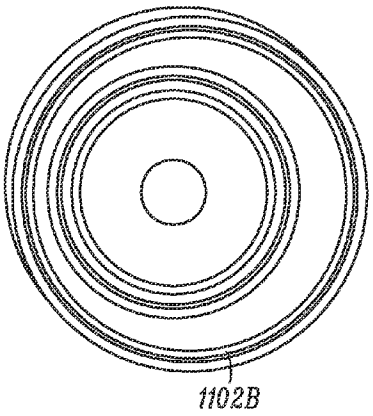
FIGS. 11A-B illustrates a pint glass shape beverage delivery can.
Figure 11A:
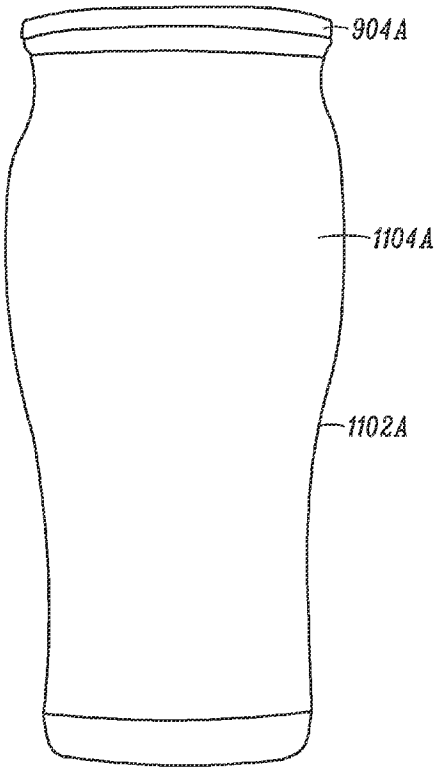
Figure 14:
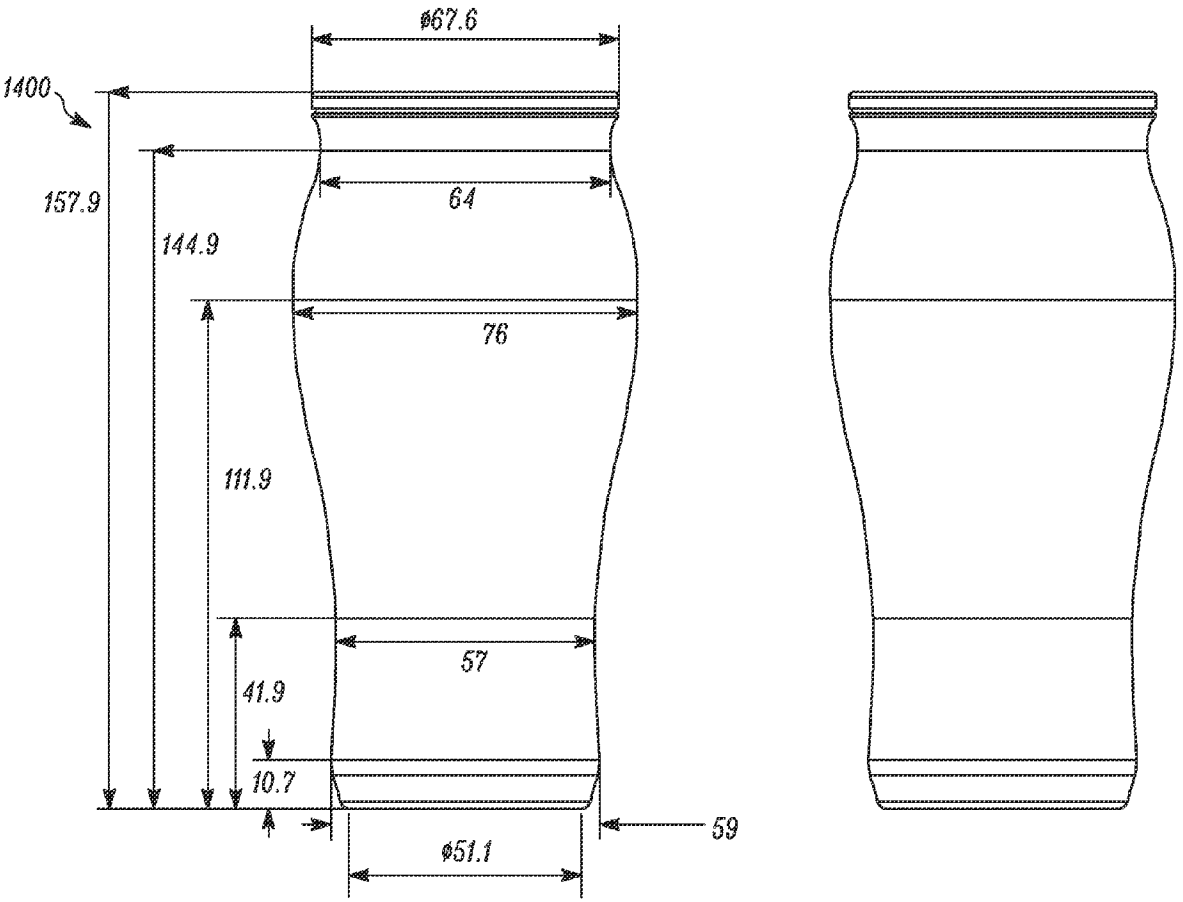
FIG. 14 illustrates an example dimension of a pint glass shape beverage can.
Figure 15A:
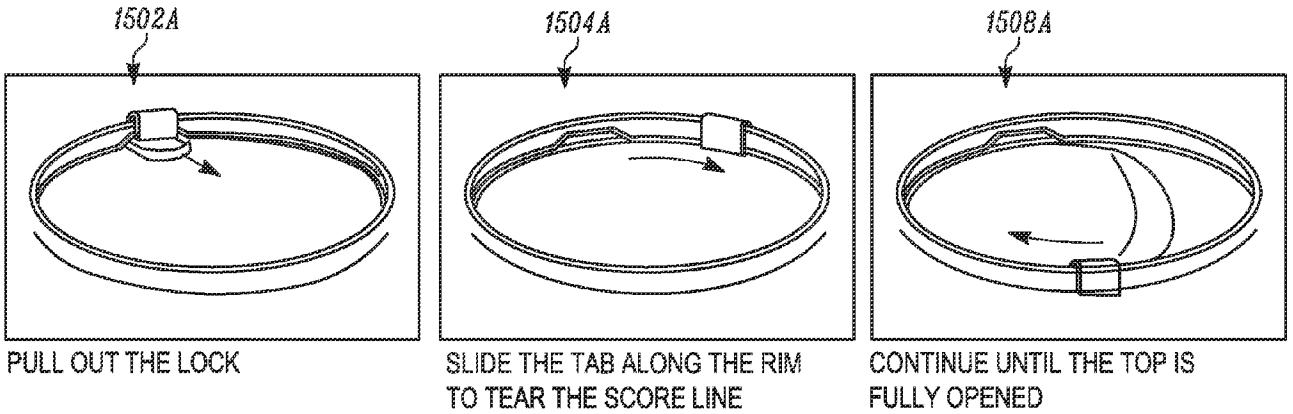
FIGS. 15 A-B illustrate one embodiment of an opening method of a pint glass shape beverage can.
Figure 15B:
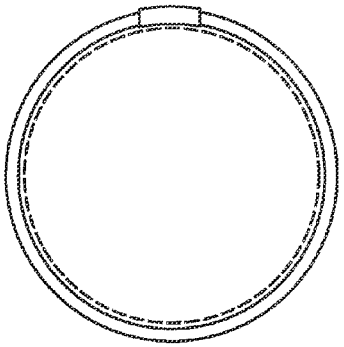

FIGS. 11A-B, 14 and 15 depict a beverage can with a pint glass shape. As illustrated by FIG. 11A-B, features of the pint glass shape may include, but are not limited to, a powdercoated top cover 904A, a body shape modeled after the pint glass 1104A and a full open aperture 1102B. FIG. 14 illustrates an example of the dimensions of one embodiment of the pint glass shape beverage can 1400. The construction details of a pint glass shape, which may include, but are limited to, a ceramic nucleator in a plastic frame, plastic disk nucleator, or laser ring nucleator, a snap-on top cover, a recessed score line and folded top cover edge. FIGS. 15 A-B illustrate one embodiment of an opening method of the pint glass shape, which may include but is not limited to pulling out the lock on the edge of the top of the can 1502A, sliding the tab on the top of the can along the rim to tear the score line 1504A and continuing until the top is fully opened 1508A. FIGS. 16 A-B depict the external packaging solution, which may include, but is not limited to a four-pack carrier 1602A where each beverage can reside within a hole on the bottom of a rectangular box. A similar packaging solution may be used for other external beverage can shapes, as described herein.

What is claimed is:

1. A beverage can comprising:

a body having an external shape, wherein the external shape is a pint glass shape;

a lid affixed to the body, wherein the lid includes a tab operable to remove a first portion of the lid to form an aperture in the lid, wherein the lid includes movable slats to enable the lid to change from an opaque state to a transparent state, wherein the aperture is shaped and sized such that a user's nose will enter the beverage can during beverage consumption, and wherein a second complementary portion of the lid remains when the can is open; and a nucleation device in the body.

2. The beverage can of claim 1 wherein the lid is concave.

3. The beverage can of claim 1 wherein the nucleation device is a ceramic nucleation device.

4. The beverage can of claim 1 wherein the nucleation device is a nucleation ring.

5. The beverage can of claim 1 wherein the nucleation device is a micro-etched plastic disc.

6. The beverage can of claim 1 wherein the nucleation device is affixed to the bottom interior of the beverage can.

7. The beverage can of claim 1 wherein the aperture is at least one of a bell shape, a peanut shape, a converging shape, a diverging shape, a shape with curvilinear contours, a shape that resembles visual elements, and a shape that resembles a design element.

8. The beverage can of claim 1 further comprising a powder-coated top cover affixed to the lid.

9. The beverage can of claim 1 further comprising at least one of a roughening and a softening surface enhancement located at least on an upper portion of the beverage can where the user's mouth touches the beverage can.

10. The beverage can of claim 9 wherein the surface enhancement comprises at least one of a resin, a polymer, and a glass material with a glass feel.

11. The beverage can of claim 1 wherein the tab comprises a twist tab capable of being twisted to puncture the lid of the can.

12. The beverage can of claim 1 wherein the tab is one of a twist tab capable of being twisted to puncture the lid of the can and a slide tab capable of being slid to tear the lid of the can, and wherein the tab is capable of attaching to at least one of the side and bottom of the can.

13. The beverage can of claim 1 wherein the tab is capable of causing material to be removed from the can to create the aperture in the lid wherein at least one of the tab and the removed lid material is capable of being attached to the can.

* * * * *

UNITED STATES PATENT AND TRADEMARK OFFICE

CERTIFICATE OF CORRECTION

PATENT NO. : 9,162,794 B2
APPLICATION NO. : 13/902437
DATED : October 20, 2015
INVENTOR(S) : Zebulon Stevens Robbins, III et al.

It is certified that error appears in the above-identified patent and that said Letters Patent is hereby corrected as shown below:

Drawings

Figures 16A, 16B:
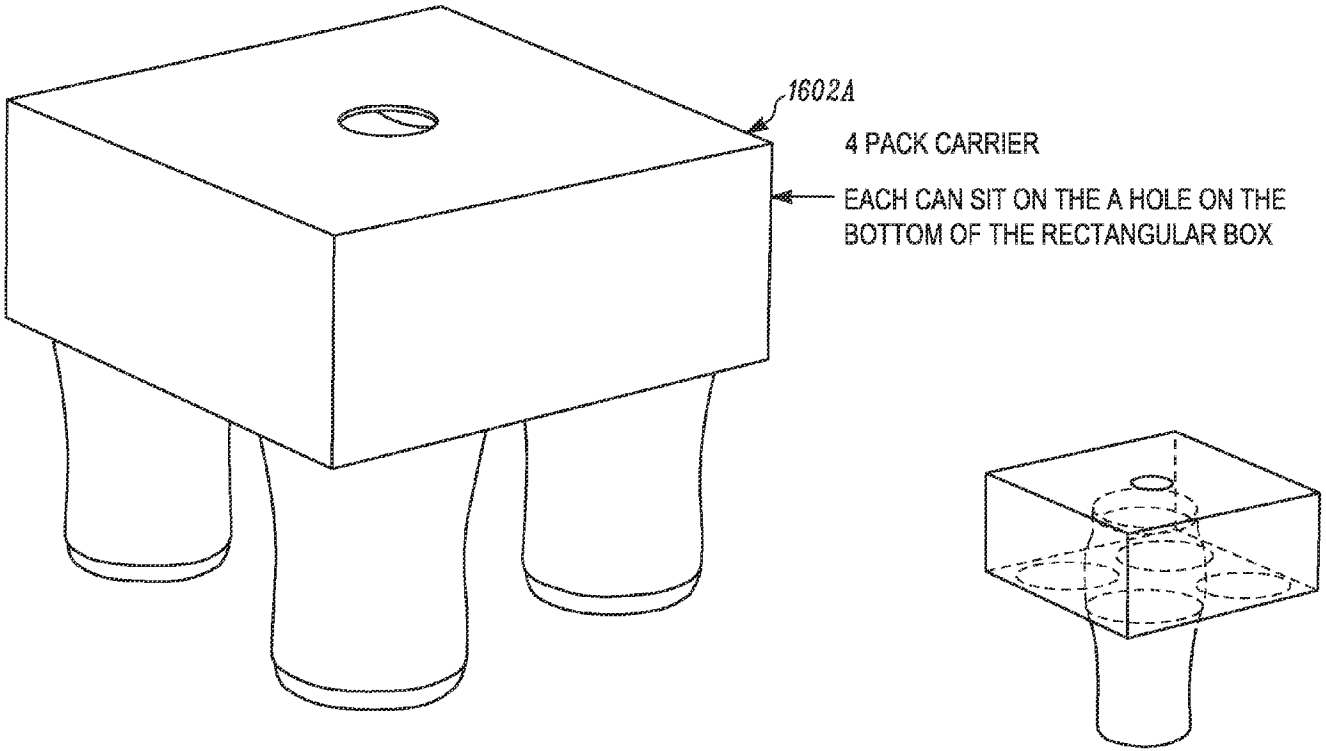
FIGS. 16 A-B illustrate an external packaging embodiment for pint shape beverage cans.

On sheet 16 of 16, in Figure 16A, line 3, delete "THE A" and insert -- A --, therefor.

Specification

In column 6, line 45, delete "and or" and insert -- and/or --, therefor.

Signed and Sealed this
Eighth Day of March, 2016

Michelle K. Lee

Michelle K. Lee
*Director of the United States Patent and Trademark Office*